United States Patent [19]

Sauer

[11] 3,965,631

[45] June 29, 1976

[54] FIRE RATED GRID-MEMBER WITH CONTROLLED EXPANSION MEANS

[75] Inventor: Gale E. Sauer, Williamsville, N.Y.

[73] Assignee: Roblin Hope's Industries, Inc., Buffalo, N.Y.

[22] Filed: Aug. 1, 1974

[21] Appl. No.: 493,551

[52] U.S. Cl. ..... 52/232; 52/573; 52/DIG. 5

[51] Int. Cl.[2] ..... E04B 1/68

[58] Field of Search ..... 52/573, 232, DIG. 5

[56] References Cited

FOREIGN PATENTS OR APPLICATIONS 848,115 8/1970 Canada ..... 52/573

*Primary Examiner*—Ernest R. Purser
*Assistant Examiner*—Carl D. Friedman
*Attorney, Agent, or Firm*—Christel & Bean

[57] ABSTRACT

A fire rated grid-member having fixed end points and the web thereof absorbing thermally induced longitudinally compression which results from fixed end point reaction forces. The grid member further includes a bead surmounting the web which is deformed to create a plurality of weakened portions which deform further upon grid member compression to thereby absorb longitudinal compression in the bead. Each deformed portion of the bead comprises opposing portions of the bead sides being crimped together to form a plane of abutment which is obliquely disposed to a limited extent with respect to the longitudinal axis of the bead. Such a disposition of the plane of abutment minimizes the reduction in compressive strength of the bead while assuring that deformation of the bead will occur in a desired manner during thermally induced compression of the grid member so as to maintain a supported grid network in position.

9 Claims, 5 Drawing Figures

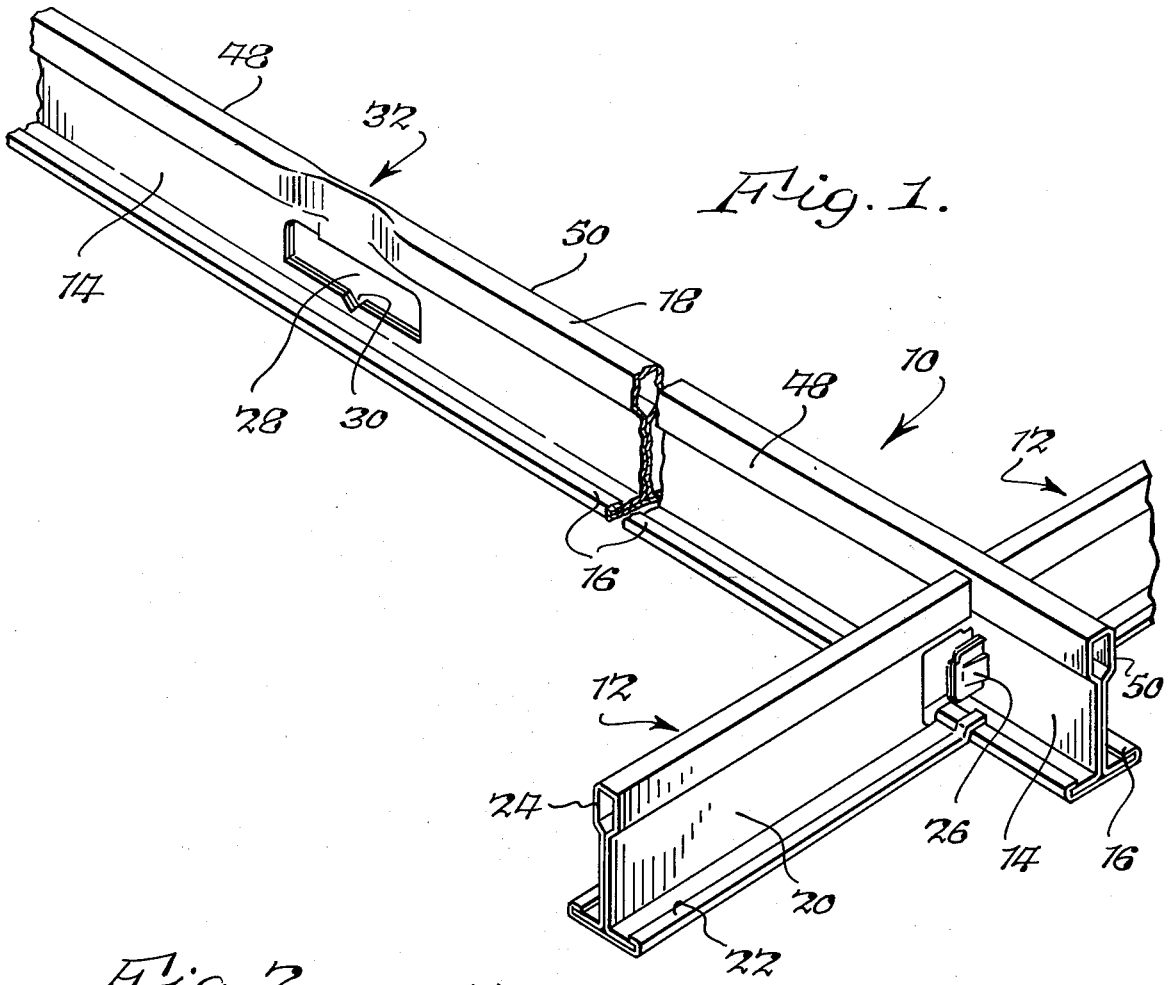
Fig. 1.
Fig. 2.
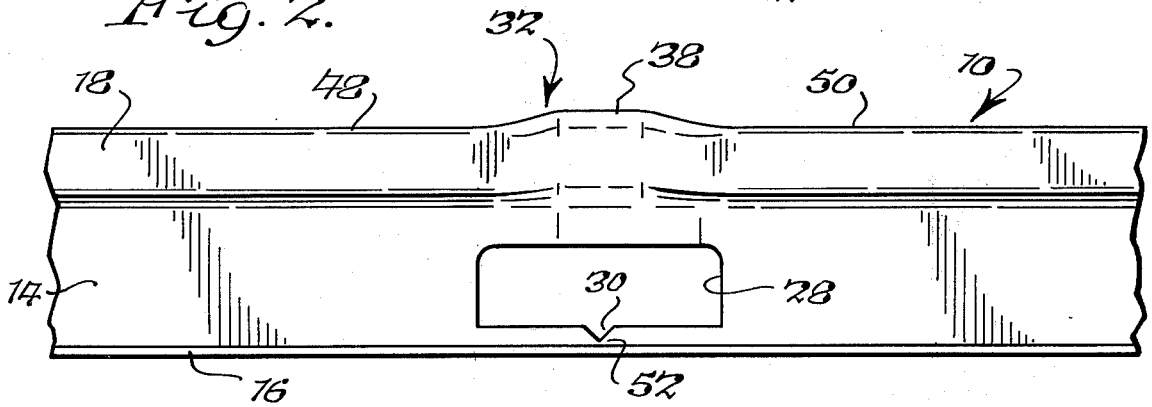
Fig. 3.
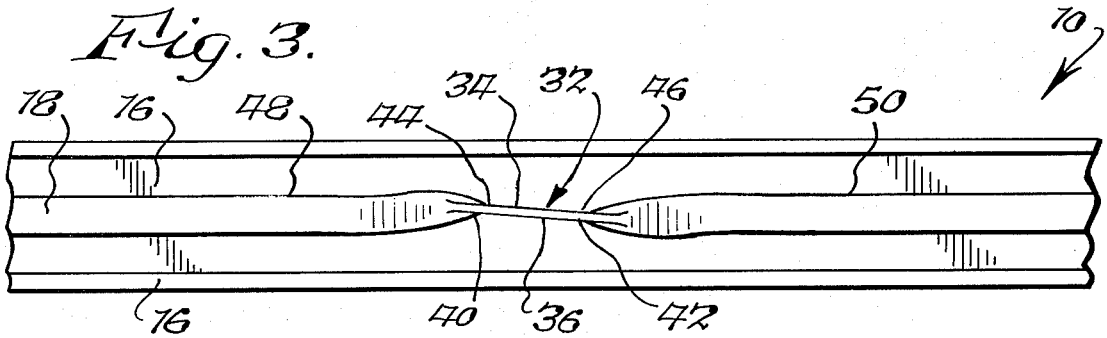

FIRE RATED GRID-MEMBER WITH CONTROLLED EXPANSION MEANS

BACKGROUND OF THE INVENTION

This invention relates generally to fire-resistant, tile supporting grid systems and the like, and more particularly, to tile supporting members capable of absorbing axial compressive elongation without substantial buckling of the supported ceiling tiles as might occur during abnormal elevated temperatures, thereby preserving the integrity of the ceiling as a fire barrier under such conditions.

The present invention is particularly adapted for use in ceiling tile supporting grid systems of the type comprising a plurality of parallel, spaced main grid members and cross grid members extending transversely between the main grid members and having end portions interlocking therewith. These interconnected grid members generally are suspended from a conventional ceiling or an overhead support structure.

One of the critical problems encountered in these ceiling tile supporting grid structures is to maintain the integrity thereof under abnormally elevated temperatures, such as accompany a fire. Under these high temperature conditions, metallic grid members, which generally are fixed at their end points, expand and buckle whereby the supported ceiling tiles are displaced and sometimes tilted to such an extent that they drop through the openings fromed by the intersecting grid members. As a result, the effectiveness of the suspended ceiling as a fire barrier is destroyed and the overhead ceiling and related support structure is exposed to fire whereby such fire can spread more easily and rapidly through the entire structure.

The prior art has considered structures for accommodating or absorbing thermally induced compression in a supporting grid structure in order to enhance the ceiling integrity during a fire. Such a prior art structure is found in U.S. Pat. No. 3,778,947 issued to Gale E. Sauer and assigned to the assignee of the present invention. As disclosed in the aforesaid Sauer patent, a discrete amount of material is removed or cut-out from the bead portion of the grid member to permit deformation thereof during the thermal compression. However, although the thermal compression can be accommodated, the strength and rigidity of the bead for resistance against normal conditions of handling, installation, and usage are inherently reduced by removal of the cut-out-material. Moreover, such a cut-out approach further results in a bead having a non-continuous profile with potentially rough edges.

SUMMARY OF THE INVENTION

Accordingly, one object of the present invention is to provide a new and improved fire rated grid-member which absorbs longitudinal compression resulting from extreme heat and provides controlled deformation of the grid member upon such compression predetermined areas so as to preserve the integrity of a supported ceiling under the elevated temperature conditions.

Another object of the present invention is to provide an improved fire rated grid-member which may be manufactured with less complex tooling as compared to tooling required for manufacturing prior art fire rated grid-members.

A further object of the present invention is to provide the aforesaid grid member with a deformed bead surmounting the web and having weakened portions therein to control the bead deformation upon compression.

Still another object of the present invention is to provide a bead having the aforesaid weakened portions but which minimizes the reduction in compressive strength of the bead as compared to prior art structures.

A still further object of the present invention is to provide a bead having weakened portions but without the inclusion of cut-out segments therein so as to yield a smooth and continuous surface and necessarily an enhanced handling and installation quality to the grid member.

In summary, the present invention provides a bead for a grid support member in which corresponding portions of the spaced bead side walls are crimped together. Such crimped portions abut one another so that they are substantially disposed in a single plane with respect to the hollow transverse cross section of the nondeformed bead portions. With the plane of the abutting side wall portions being formed obliquely to the longitudinally axis of the bead, any compression in the bead is absorbed by a folding of the plane defined by the crimped side wall portions.

The foregoing and other objects, advantages, and characterizing features of the present invention will become clearly apparent from the ensuing detailed description of an illustrative embodiment thereof, taken together with the accompanying drawings wherein like reference characters denote like parts throughout the various views.

BRIEF DESCRIPTION OF THE DRAWINGS

FIG. 1 is a fragmentary, perspective view of intersecting grid members incorporating a fire rated main grid member of this invention.

FIG. 2 is a fragmentary, side elevational view of a fire rated main grid member of this invention.

FIG. 3 is a fragmentary top plan view of the fire rated grid member shown in FIG. 2.

DETAILED DESCRIPTION OF A PREFERRED EMBODIMENT

Figure 4:
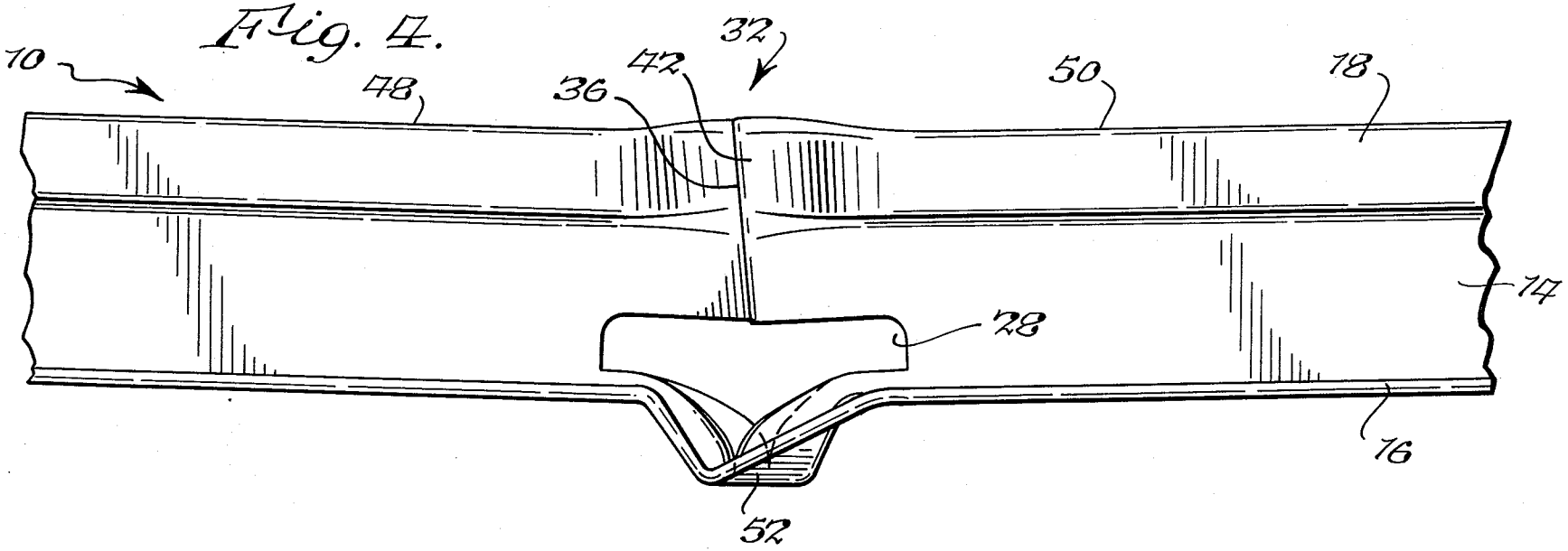
FIG. 4 is a fragmentary side elevational view of the fire rated grid member of this invention after the grid member has been subjected to thermally induced longitudinal expansion.

Referring now in detail to the illustrative embodiment depicted in the accompanying drawings, there is shown in FIG. 1 a ceiling tile supporting grid system incorporating a main T support member, generally designated 10, which is detachably connected to a pair of cross T support members, generally designated 12. Main T member 10 can be conveniently fabricated from a single piece of any suitable material, preferably an inexpensive, lightweight metal such as soft steel for example, and is formed to provide a generally vertical web portion 14 upstanding from laterally projecting, tile supporting or load carrying flanges 16 on opposite sides thereof and surmounted by a generally box-shaped, longitudinally extending, reinforcing member or bead means 18. As can be seen in FIG. 1, the bottom portion of the bead means is somewhat contoured in order to provide a smooth intersection with the web 14, but for purposes of description the bead can be viewed as being normally hollow and substantially rectangular in transverse cross section.

Web portion 14 is provided at set intervals with appropriate slots for reception of the end portions of cross members 12. Cross T members 12 can also be fabricated from a single piece of any suitable material, such as soft steel by way of example, and formed to provide a normally vertical web portion 20 upstanding from laterally projecting, tile supporting flanges 22 and surmounted by a generally rectangular or boxshaped, longitudinally extending, reinforcing members or bead 24. It should be appreciated that reinforcing members or bead means 18 and 24 could take various shapes in cross-section, such as a rounded or oval shape, as desired. As further shown in FIG. 1, two cross T support members 12 extend perpendicularly to main T support member 10 on opposite sides thereof with their respective adjoining tongue portions 26 inserted into and through an appropriate slot in member 10 for interlocking engagement with web portion 14. The main T support member 10 includes throughout its length at predetermined spaced intervals a plurality of slots for corresponding pairs of interlocking cross T members 12 to assume an assembled relationship as typically shown in FIG. 1. However, various interlocking cross T arrangements can be utilized with corresponding slots in the main grid member, as will be readily understood by those skilled in the art. For additional details of the illustrated cross T arrangement, reference is made to U.S. Pat. No. 3,746,379 issued on July 17, 1973, and to pending U.S. Application Ser. No. 397,432, filed Sept. 14, 1973, both of which are assigned to the same assignee as is present invention.

In accordance with the present invention, main T support member 10 is formed in such a manner as to confine compressive elongation thereof under abnormally elevated temperatures to predetermined areas in an effort to preserve the integrity of the ceiling. A typical cut-out section, generally designated 28, is provided in web portion 14 of the main T support member 10. The cut-out portion 28 further includes a downwardly extending V-shaped notch 30 as is to be seen in FIG. 2. The cut-out 28 serves as an absorbing means for longitudinal elongation of the web portion during compression of the grid member. Such absorption of compressive elongation is necessary when the main grid member 10 is in an assembled position with the end points thereof restricted against any expansive movement. While only one cut-out 28 is shown in FIG. 1, it should be understood that additional cut-outs could be utilized in the present invention along the length of grid member 10. It should be further understood that the cut-out 28 is only generally representative of a longitudinal compression absorption means for the web portion of a grid member.

For additional details as to an alternative structure for this portion of the web, reference is made to U.S. Pat. No. 3,778,947, issued Dec. 18, 1973, and assigned to the same assignee as is the present application.

The present invention is specifically directed to the deformed portion of bead 18 generally indicated as 32 in FIG. 1. As more clearly seen in FIGS. 2 and 3, the aforesaid deformed portion of the bead means includes opposed side portions 34 and 36 which are crimped together into planar abutment as most clearly seen in FIG. 3. Such crimping of the normally hollow bead results in a protrusion of the planar abutment above the bead. This is to be seen as portion 38 in FIG. 2. In addition, the planar abutment of portions 34 and 36 result in fold lines 40, 42, 44, and 46 being defined by the intersections of the aforesaid planar abutment portions of 34 and 36 and the side portions of the bead 18 not lying in such plane of abutment. In viewing FIGS. 1 and 3 together, it can be seen that the non-deformed segments 48 and 50 of the bead are substantially parallel to the plane of the web 14 and the longitudinal axis of the bead. However, the deformed abutting portions 34 and 36 of the bead lie in a plane which is oblique to the longitudinal axis of the bead and necessarily the longitudinal axis of the entire grid member. The plane of abutment of deformed portions 34 and 36 is formed at such an angle to the longitudinal axis of the bead to insure upon compressive elongation of the grid member 10, that the aforesaid plane of abutment will fold in a longitudinal sense about fold lines 40, 42, 44, and 46 denoted above. It is only necessary that the acute angle formed between the plane of abutment and the longitudinal axis of the bead be large enough to insure that the fold lines 42 and 46 will revolve in a clockwise direction will respect to fold lines 40 and 44. In this manner the reduction in compressive strength of the bead can be minimized. Furthermore, all of the fold lines are disposed perpendicularly to the longitudinal axis of the bead and simply revolve or translate as viewed in FIG. 3 when opposing compressive forces are imparted to both ends of the plane of abutment. The folding of the plane of abutment results from the fact that the longitudinal components of the forces of compression in the bead portion of the grid member are not axially aligned and therefore impart the clockwise folding to the plane of abutment in FIG. 3.

As viewed in FIG. 2, the deformed portion 32 of the bead is provided to absorb the compressive elongation in the bead 18 while the cut-out 28 serves to absorb longitudinal compression substantially in the web portion of the grid member.

With the ends of the main grid member 10 fixed or restricted with respect to movement in an axial or longitudinal direction and upon application of heat to the ceiling structure, such as might be caused by fire, the grid support or grid member 10 tends to expand or elongate and would buckle unless such potential expansion can be compressively absorbed by member 10. In the present invention such potential expansion or elongation is absorbed by controlled deformation of member 10 with the end points thereof remaining in fixed position.

The compressive reaction forces acting axially on the opposite ends of main grid member 10, caused by the induced expansion thereof, are transmitted though the body of member 10, including the narrow, connecting portion 52 of the web 14. It is to be appreciated that the lower surfaces of flanges 16 are directly exposed to the heat of a fire and these flanges initially become compressed to a greater degree than the web portion 14 thereabove which is somewhat insulated by flanges 16 and the supported ceiling tiles. The narrow connecting portion 52 of web portion 14 offers less resistance to compressive deformation than any other portion of the web and therefore deflection of flanges 16 tends to occur adjacent to connecting portion 52. Accordingly, flanges 16 will bend downwardly upon folding of the notch 30, carrying the web material adjacent to connecting portion 52 therewith. As seen in FIG. 4 of the drawings, upon a full compressive expansion of the main grid member 10, the connecting portion 52 and those portions of flanges 16 adjacent to the connecting portion 52 assume a downwardly disposed V-shaped contour.

Figure 5:
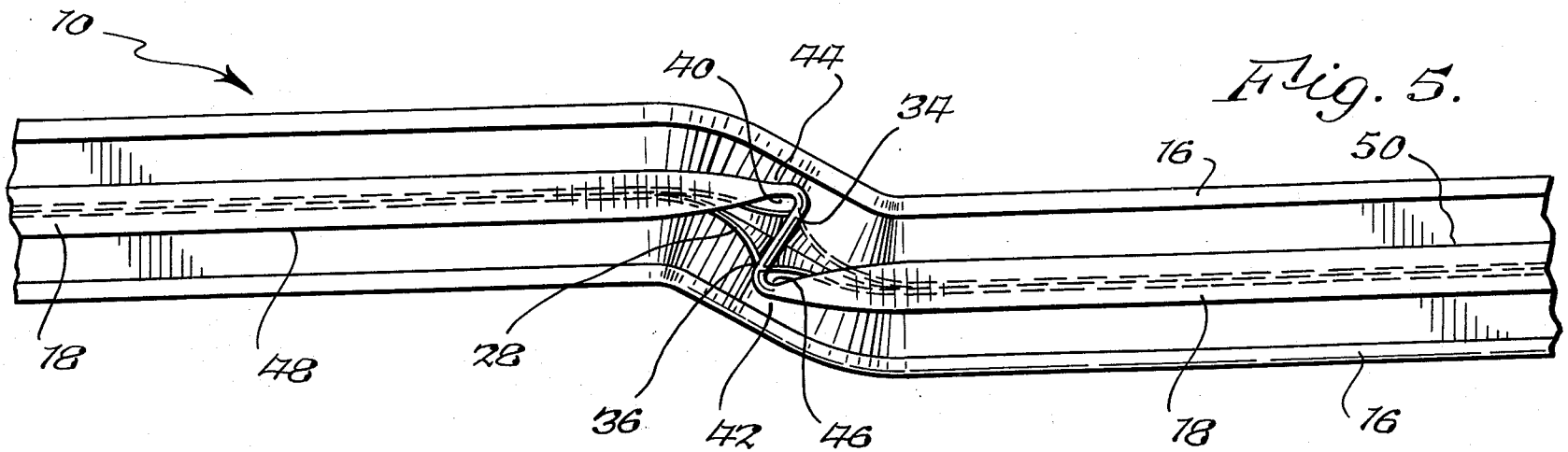
FIG. 5 is a fragmentary top plan view of the fire rated grid member shown in FIG. 4.

Corresponding compressive elongation in the bead portion of the grid member is correspondingly absorbed by the structure disclosed as constituting the present invention. As is to be seen in the top view of FIG. 5, the plane of abutment of the deformed bead side walls 34 and 36 has folded about the fold lines described hereinabove. In this regard it is to be appreciated from FIG. 4 that all of the compressive expansion in both bead 18 and the web 14 is absorbed at the same axial location when the deformed portion 32 of the bead is axially aligned with the compression absorption means of the web or more specifically the cut-out structure 28. With such axial alignment of the deformed portion 32 of the bead and the cut-out 28 of the web, the fold lines of the deformed portion 32 may be extended through the top portion of the web to the upper edge of the cut-out as seen in FIG. 2. In this manner absorption of expansion occurs at one axial location from the uppermost part of the bead to the lowermost part of the web. However, it is not necessary in the present invention that the fold lines extend through the upper part of the web but such structure is to be understood as only part of a preferred embodiment and a feature facilitating a smooth deformation of the grid member.

The applicant's present invention contemplates the utilization of material on the order of .016 of an inch thick with the axial length of each plane of abutment of the bead portions 34 and 36 being approximately one-half of an inch. It is furthermore contemplated that each axial end point of each such plane of abutment be off-set approximately .020 of an inch from the longitudinal axis of bead 18 to insure proper folding of the plane of abutment upon internal expansion of the grid member. It is also anticipated that the tooling required to crimp the abutting bead portions together will be less complex and expensive than tooling used in prior art structures.

The main grid support member 10 of this invention satisfactorily passed the two-hour ASTM Fire Endurance Test conducted in accordance with the Standard Methods of Fire Tests on Floor and Ceiling Construction. In this test, a section of a ceiling construction, including the main and cross T support members and ceiling tiles supported therein, was exposed to fire at temperatures ranging from 1,000 degrees to 1,900 degrees Farenheit. The main T support member 10 of the present invention readily met the fire rated requirements consistent with the fire endurance time of two hours. Flanges 16 of main T support member 10 did not deform sufficiently, even at its maximum deflection during this two hour period, to disrupt the continuity of the ceiling system, thus maintaining the overall integrity of the ceiling structure. Moreover, the specimen tested serves as a fire retarding and heat transmission barrier to prevent the fire from spreading to other superstructure.

From the foregoing, it is apparent that the objects of the present invention have been fully accomplished. As a result of this invention, an improved fire-rated grid member is provided for maintaining the integrity of a ceiling structure upon the application of heat to thereby preserve the fire retarding qualities thereof by preventing the escape of heat therethrough to the superstructure.

I claim:

1. An improved grid member for supporting grid systems and the like, said grid member having a web means, load carrying flange means extending laterally outwardly of said web means, and a bead means having opposed sidewall portions surmounting said web means and being longitudinally aligned therewith for providing increased rigidity to said grid member, and said web means including a cut-out portion in a disposition intermediate to said load carrying flange means and said bead means for absorbing longitudinal compression therein, wherein said improvement comprises: said bead means being normally hollow in transverse cross-section and having at least one deformed portion along the longitudinal length thereof, said deformed portion having correspondingly opposed sidewall portions of said bead means formed into substantially planar abutment with one another so that said deformed portion is substantially non-hollow in transverse cross section, and said plane of abutment so formed between said deformed sidewall portions being slightly oblique to the longitudinal axis of said bead means so that during longitudinal compression of said bead means, said plane of abutment folds in a longitudinal direction to absorb such longitudinal compression.

2. An improved grid member as claimed in claim 1 wherein the non-deformed portion of said bead means is substantially rectangular in transverse cross-section.

3. An improved grid member as claimed in claim 2 wherein one pair of sides of said bead means is substantially parallel to the plane of said web means and includes said correspondingly opposed side portions of said bead means formed into planar abutment.

4. An improved grid member as claimed in claim 3 wherein said deformed portion includes fold lines, said fold lines being defined by the intersections of said plane of abutment and the side portions of said bead means not lying in said plane of abutment.

5. An improved grid member as claimed in claim 4 wherein said fold lines are disposed perpendicularly to the longitudinal axis of said bead means.

6. An improved grid member as claimed in claim 5 wherein the acute angle extending between the longitudinal axis of said bead means and said plane of abutment is formed only so large as to insure folding of said plane of abutment during longitudinal compression of said grid member.

7. An improved grid member as claimed in claim 6 wherein said deformed portion is longitudinally aligned with said web cut out portion and said plane of abutment is formed to extend into said web means to intersect said cut out portion therein.

8. An improved grid member as claimed in claim 7 wherein said fold lines extend into and are formed as part of said web means.

9. An improved grid member as claimed in claim 8 wherein said cut-out portion of said web means includes a V-shaped notch extending downwardly from the edge of said cut-out portion adjacent to said load carrying flange means.

* * * * *

UNITED STATES PATENT AND TRADEMARK OFFICE

CERTIFICATE OF CORRECTION

PATENT NO. : B1 3,965,631

DATED : March 31, 1987

INVENTOR(S) : Gale E. Sauer

It is certified that error appears in the above-identified patent and that said Letters Patent is hereby corrected as shown below:

On the Title Page:

The following should be added as prior art of record:

3,846,031 Adams 4,016,701 Beynon 3,388,519 Downing 1,038,585 Canadian

Signed and Sealed this

Twenty-fifth Day of August, 1987

*Attest:*

DONALD J. QUIGG

*Attesting Officer*

*Commissioner of Patents and Trademarks*

REEXAMINATION CERTIFICATE (657th)

United States Patent [19] [11] B1 3,965,631

Sauer [45] Certificate Issued Mar. 31, 1987

[54] FIRE RATED GRID-MEMBER WITH CONTROLLED EXPANSION MEANS

[75] Inventor: Gale E. Sauer, Williamsville, N.Y.

[73] Assignee: Donn-Incorporated, Westlake, Ohio

Reexamination Request:
No. 90/001,015, May 27, 1986

Reexamination Certificate for:

| | |
|---|---|
| Patent No.: | **3,965,631** |
| Issued: | **Jun. 29, 1976** |
| Appl. No.: | **493,551** |
| Filed: | **Aug. 1, 1974** |

[51] Int. Cl.[4] ..... E04B 1/68

[52] U.S. Cl. ..... 52/232; 52/573; 52/DIG. 5

[58] Field of Search ..... 52/1, 573, 232, DIG. 5

[56] References Cited

FOREIGN PATENT DOCUMENTS 848115 8/1970 Canada ..... 52/573

OTHER PUBLICATIONS

"Luminaire", Armstrong Publication, p. 18.

*Primary Examiner*—Carl D. Friedman

[57] ABSTRACT

A fire rated grid-member having fixed end points and the web thereof absorbing thermally induced longitudinally compression which results from fixed end point reaction forces. The grid member further includes a bead surmounting the web which is deformed to create a plurality of weakened portions which deform further upon grid member compression to thereby absorb longitudinal compression in the bead. Each deformed portion of the bead comprises opposing portions of the bead sides being crimped together to form a plane of abutment which is obliquely disposed to a limited extent with respect to the longitudinal axis of the bead. Such a disposition of the plane of abutment minimizes the reduction in compressive strength of the bead while assuring that deformation of the bead will occur in a desired manner during thermally induced compression of the grid member so as to maintain a supported grid network in position.

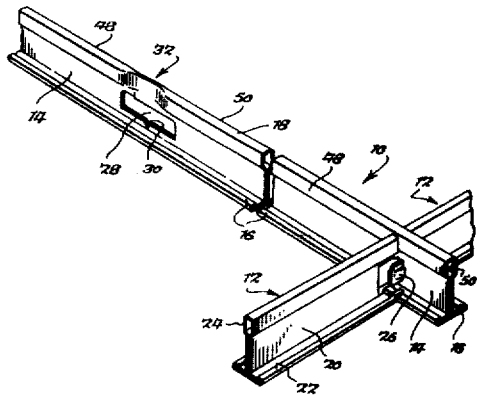

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–9 is confirmed.

New claims 10–15 are added and determined to be patentable.

*10. An improved grid member as set forth in claim 1, wherein during said longitudinal compression of said bead means the portions of said bead means adjacent to said deformed portion are shifted laterally in opposite directions out of alignment by said deformed portion being slightly oblique.*

*11. An improved grid member as set forth in claim 1, wherein said deformed portion deformed into substantially planar abutment has a predetermined length, said deformed portion permitting longitudinal compression through a distance greater than said predetermined length due to the folding of said deformed portion.*

*12. An improved grid member as set forth in claim 1, wherein during said longitudinal compression a bend occurs between each end of said planar abutment and the adjacent portions of said bead causing said beads to be displaced laterally in opposite directions by said slight oblique deformed portion, folding of said deformed portion permitting longitudinal compression to a position in which said adjacent portions of said bead overlap.*

*13. An improved grid member as claimed in claim 5, wherein said deformed portion is longitudinally aligned with said web cutout portion and said plane of abutment is formed to extend into said web means to intersect said cutout portion therein.*

*14. An improved grid member as claimed in claim 13, wherein said fold lines extend into and are formed as part of said web means.*

*15. An improved grid member as claimed in claim 14, wherein said cutout portion of said web means includes a V-shaped notch extending downwardly from the edge of said cutout portion adjacent to said load-carrying flange means.*

* * * * *